United States Patent [19]

Churchman

[11] 4,248,302

[45] Feb. 3, 1981

[54] METHOD AND APPARATUS FOR RECOVERING VISCOUS PETROLEUM FROM TAR SAND

[75] Inventor: Ronald K. Churchman, Carrollton, Tex.

[73] Assignee: Otis Engineering Corporation, Dallas, Tex.

[21] Appl. No.: 33,514

[22] Filed: Apr. 26, 1979

[51] Int. Cl.[3] ..... E21B 33/124; E21B 43/24

[52] U.S. Cl. ..... 166/272; 166/50; 166/52; 166/269

[58] Field of Search ..... 166/272, 303, 50, 52, 166/269, 191, 315

[56] References Cited

U.S. PATENT DOCUMENTS

| | | | |
|---|---|---|---|
| 2,497,868 | 2/1950 | Dalin | 166/303 U X |
| 3,386,508 | 6/1968 | Bielstein et al. | 166/272 |
| 3,456,730 | 7/1969 | Lange | 166/272 X |
| 3,960,213 | 6/1976 | Striegler et al. | 166/272 |
| 3,960,214 | 6/1976 | Striegler et al. | 166/272 |
| 3,986,557 | 10/1976 | Striegler et al. | 166/272 |
| 3,994,340 | 11/1976 | Anderson et al. | 166/272 |
| 4,007,788 | 2/1977 | Striegler et al. | 166/272 |
| 4,037,658 | 7/1977 | Anderson | 166/272 |
| 4,099,783 | 7/1978 | Verty et al. | 166/272 X |

*Primary Examiner*—Stephen J. Novosad
*Attorney, Agent, or Firm*—Vinson & Elkins

[57] ABSTRACT

A method of recovering viscous petroleum from tar sand formations utilizing a deviated steam injection well with pump-down (through the flow line) completion. The steam injection well may use side pocket mandrels with constant flow or orifice regulators to control steam injection rates into the surrounding viscous petroleum formation. A plurality of pumping wells are situated along the drill path of the steam injection well and substantially above injection points for recovery of the fluidized petroleum.

13 Claims, 2 Drawing Figures

30
32
34
36
18
16
14
12
28
24
27
26
23
22
20
19
17
10

METHOD AND APPARATUS FOR RECOVERING VISCOUS PETROLEUM FROM TAR SAND

BACKGROUND OF THE INVENTION

1. Field of the Invention

This invention relates to the recovery of viscous petroleum from tar sands. More particularly, the invention relates to use of steam injected into a tar sand using pumpdown completion techniques, with recovery of the petroleum by means of production wells spaced along the deviated path of the steam injection well.

2. The Prior Art

There is continuing effort to discover a commercially practical method of recovering significant quantities of petroleum from "viscous" deposits. By "viscous" is meant petroleum deposits having a viscosity on the order of 100,000 to 1,000,000 centipoise (cp) at reservoir temperatures, such as found in the Athabasca deposits.

A major problem for economic recovery from such formations is the establishment of a suitable flow path between a source of heat and means for recovering liquid products. There are numerous patents claiming methods that have been discovered to allegedly achieve this goal.

A recent patent, U.S. Pat. No. 4,037,658, issued to Donald J. Anderson, utilizes the flow of a hot fluid through a conduit, connecting two vertical wells, to fluidize the surrounding viscous petroleum. Steam is injected into one of the wells to drive the fluidized petroleum along the path of the conduit to the second well, from wich the petroleum is recovered. While the patentee uses a deviated injection well as a source of heat, he intersects the producing well to provide a continuous flow path for "heating" steam that is conducted through conduit. A second source of steam is injected into the formation, through casing perforations in the injection well, above the packer, to drive fluidized petroleum horizontally along the path of conduit into the producer well.

U.S. Pat. No. 3,960,213, issued to John H. Striegler, et al, teaches and claims a method for recovering viscous petroleum from tar sand formations utilizing a deviated steam injection well. The tar sand formation is penetrated by a horizontally deviated injection well and a plurality of production wells positioned above and along the injection well. This patent claims use of perforated, continuous liner in the injection well. A companion patent, U.S. 3,960,214, claims casing the injection well and perforations provided where it is in contact with the formation.

Other patents in this field are U.S. Pat. Nos. 3,994,340; 3,020,901; 3,986,557 and 4,007,788. A somewhat older patent in the field is U.S. Pat. No. 3,386,508 issued to W. J. Bielstein et al. However, none of these patents are directed to the possible use of pumpdown completion techniques wherein it is possible to use controlled release of steam through valve regulated side pocket mandrels.

A recognized problem, in using steam to fluidize viscous petroleum is the difficulty of establishing and maintaining communication between the injection sites and the means for recovering the fluidized petroleum. Also, there is the problem of maintaining a sufficiently high temperature in the rejection region to maintain the petroleum in a fluidized state until it can be flowed from the production well.

These and other related disadvantages have been overcome in the present invention, which is described and claimed hereinafter.

It is therefore an object of the present invention to provide a deviated, steam-injection well that will utilize through the flowline (TFL) completion to inject steam into a viscous petroleum deposit for fluidizing same.

It is a further object to provide for recovery of such fluidized viscous petroleum by use of production wells situated essentially along and above the steam injection sites.

Yet another object is to provide variable flow steam injection sites along the steam injection well tubing path.

Another object is to provide regulated steam injection sites along the steam injection well tubing path.

SUMMARY OF THE INVENTION

A method of recovering petroleum from subterranean viscous petroleum tar sands comprising drilling an injection well whose drill path is deviated from the perpendicular, and extends for a major portion of its length into said subterranean viscous petroleum tar sand, inserting casing within said injection well to at least a point just beyond a site determined to be a terminal injection point, perforating said casing at selected locations, running into the bore of said perforated casing a dual tubing string providing a circulation path for the use of through the flowline (TFL) service tools, at least one of said dual tubing strings having a plurality of spaced apart side pocket mandrels, packing off the tubing casing annulus situated between the uppermost side pocket mandrel and the surface of the well, providing means in said side pocket mandrel for regulating the flow of fluids from the bore of the tubing to the outside thereof, drilling and completing a plurality of production wells into said subterranean viscous petroleum tar sands positioned above and along the length of said injection well, circulating a heated fluid through said injection well, said heated fluid flowed through said flow regulator means into said subterranean viscous petroleum tar sands to reduce the viscosity of the petroleum contained therein, and recovering said reduced viscosity petroleum by said production wells.

DESCRIPTION OF THE PREFERRED EMBODIMENTS

Figure 1:
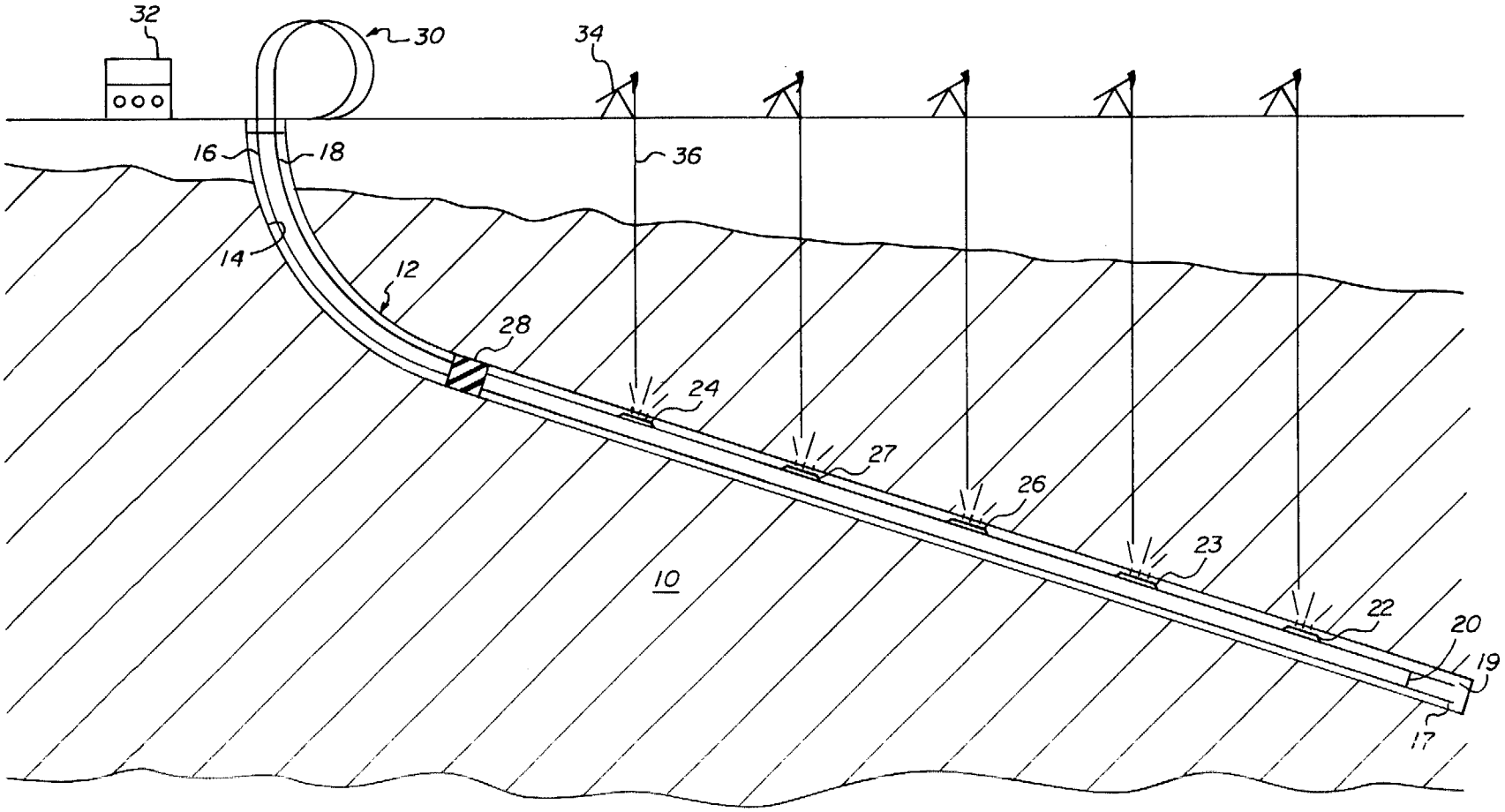
FIG. 1 is a schematic representation of the present invention showing a dual tubing circulation path for a TFL completed injection well deviated through a subterranean viscous petroleum tar sand, with a series of production wells drilled and positioned along the injection well.

In the drawing, FIG. 1, there is shown schematically a deviated well 12 drilled diagonally through a subterranean deposit 10 of a viscous petroleum, such as the Athabasca deposits of Canada. Preferably, a perforated casing or liner 14 is run into the well to a point at least just below the farthest point it is desired to inject steam into the deposit 10.

A "dual" string 16 and 18 of well tubing is then run into the well 12, with suitable packers 28 and an H-member 20 to provide a circulation path for TFL completion. TFL completion is described in the *Composite Catalogue of Oil Field Equipment and Services*, 1974-75 Edition, published by World Oil, Houston, Tex., pages 4069-80. Dual completion packers are illustrated and described therein at page 4076. However, packers useful in the present invention would have to be modified, by use of high temperature resistant elastomers or asbestos as sealing elements, in order to withstand the steam injected into the tubing 16 and 18.

Steam is to be injected into the viscous petroleum deposit 10 through the tubing 18 via ports (not shown) in side pocket mandrels made up in the tubing string 18. Suitable side pocket mandrels suitable for this purpose are shown on page 4079 of the *Composite Catalogue*, and are manufactured by Otis Engineering Corporation.

The flow of the steam is metered into the deposit 10 by use of constant flow or orifice regulators set in the side pocket mandrels 22, 23, 24, 26 and 27. One such suitable flow regulator is illustrated on page 589 of the *Composite Catalogue*, and is identified as a Model "BF" downhole flow regulator and is manufactured by Baker Oil Tools. Kickover tools, for setting and retrieving TFL flow regulators, are illustrated on page 4079 of the *Composite Catalogue*.

Use of either constant flow or orifice regulators is dictated by injection requirements of the well operator. Generally, constant flow regulators will permit the flow of steam at a constant rate regardless of fluctuations of tubing pressure. Orifice regulators generally provide metering at a rate dependent on internal tubing pressure, and are thus variable in flow.

An H-member 20 would be installed beyond the last side pocket mandrel 22 and at a point above the terminal sites 17 and 19 of the tubing strings 16 and 18, respectively. The H-member is a key component in a TFL completion equipment package.

The H-member provides the dual circulation paths necessary for pumpdown operations. A suitable H-member, for use in the present invention is manufactured by Otis Engineering Corporation and is illustrated on page 4076 of the *Composite Catalogue*. The particular models useful herein are the "double bypass" and the regular "H" cross-over. Cross-over or H-members satisfactory for use with the present invention are shown in U.S. Pat. No. 3,664,427 and U.S. Pat. No. Re. 28,588. Both patents are incorporated by reference for all purposes in this written description.

Figure 2:
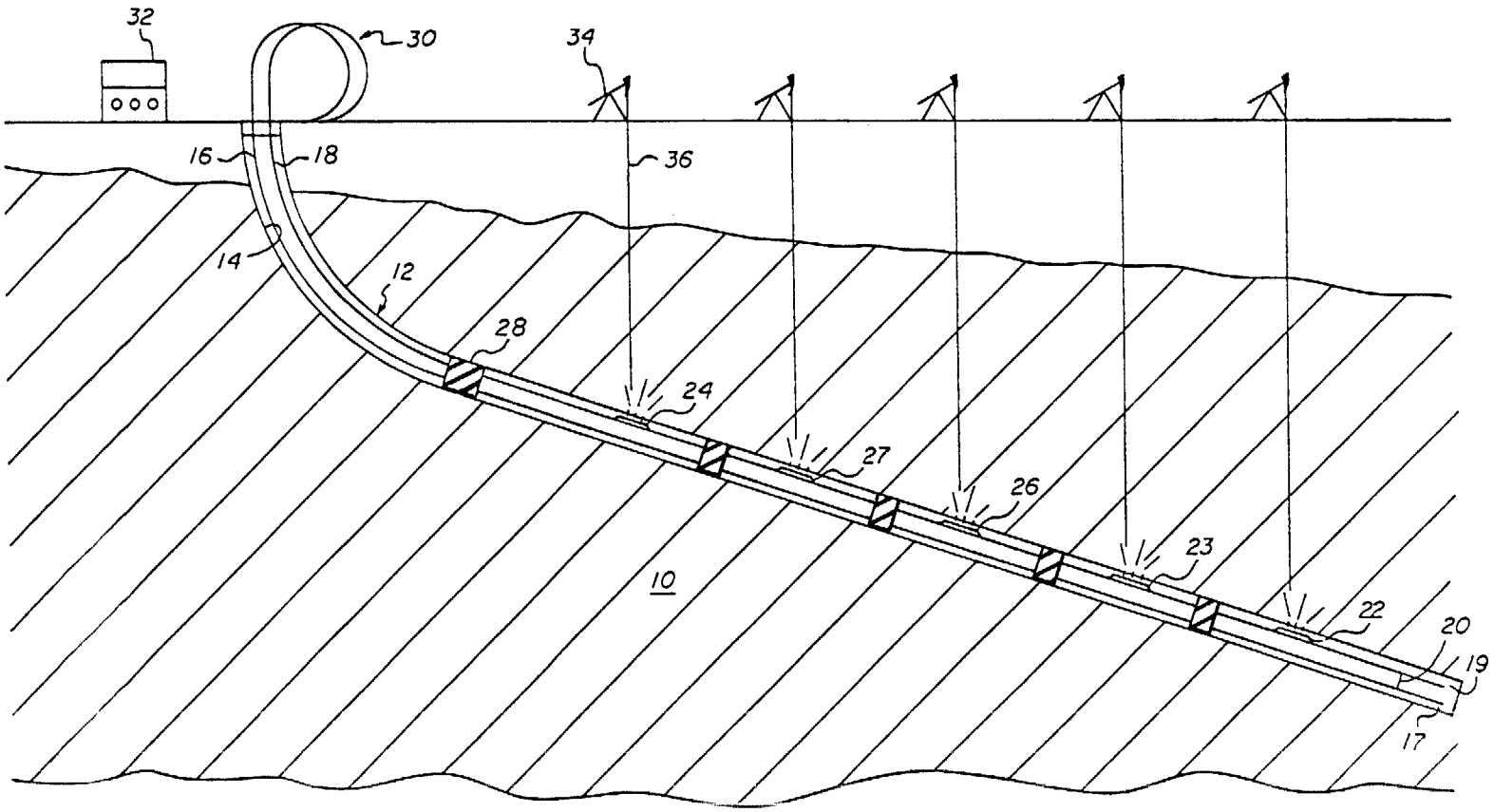
FIG. 2 is a schematic representation of one embodiment of the invention whereby pack off means are placed between steam injection points.

While FIG. 1 shows a single packer 28 set between the surface of the well and the uppermost side pocket mandrel 24, if desired, dual hydraulic steam packers could be placed between the steam injection points, as shown in FIG. 2. This would provide increased selectivity in steam injection of each fluidized zone. Thus, a series of flow regulators could be placed sequentially in the side pocket mandrels to permit injection into selected zones without injecting into all zones.

Production wells 34 are drilled and completed above each steam injection zone, along the path of the deviated steam injection wells 12. As the petroleum is fluidized by the action of the steam, the fluidized petroleum is brought to the surface using the production well 34.

It is recognized that a series of deviated wells could be drilled off the same vertical entry point. Thus, one could produce at many points radiating from a single injection site. There could be optimum recovery from such single injection well by utilization of the multipath deviation, since only a single steam generation source 32 would be required to service a relatively large area.

Various modifications could be made in one or more of the individual features described herein without departing from the scope of the invention.

What is claimed is:

1. A method of recovering petroleum from subterranean viscous petroleum tar sands comprising drilling an injection well whose drill path is deviated from the perpendicular, and extends for a major portion of its length into said subterranean viscous petroleum tar sand, inserting casing within said injection well to at least a point just beyond a site determined to be a terminal injection point, perforating said casing at selected locations, running into the bore of said perforated casing a dual tubing string providing a circulation path for the use of through the flowline service tools, at least one of said dual tubing strings having a plurality of spaced apart side pocket mandrels, providing means for packing off the tubing casing annulus situated between the uppermost side pocket mandrel and the surface of the well, providing means in said side pocket mandrels for regulating the flow of fluids from the bore of the tubing to the outside thereof, drilling and completing a plurality of production wells into said subterranean viscous petroleum tar sands positioned above and along the length of said injection well, circulating a heated fluid through said injection well, said heated fluid flowing through said flow regulator means into said subterranean viscous petroleum tar sands to reduce the viscosity of the petroleum contained therein, and recovering said reduced viscosity petroleum by said production wells.

2. The method of claim 1, wherein there is provided a constant flow regulator in said side pocket mandrels for regulating the flow of fluids from the bore of the tubing to the outside thereof.

3. The method of claim 1, wherein there is provided an orifice regulator in said side pocket mandrels for regulating the flow of fluids from the bore of the tubing to the outside thereof.

4. The method of claim 1, additionally providing a plurality of means, positioned along said dual tubing string for packing off the tubing casing annulus between said side pocket mandrels.

5. The method of claim 4, wherein there is flowed a heated fluid through preselected regulator means into said subterranean viscous petroleum tar sands.

6. The method of claim 1, wherein there is drilled a plurality of injection wells whose drill paths are deviated from the perpendicular, each radiating from essentially the same, central drill point, and each such deviated drill paths extending for a major portion of their length into said subterranean viscous petroleum tar sand.

7. The method of claim 1, wherein there is drilled a plurality of production wells into said subterranean viscous petroleum tar sands and positioned above and along the length of said injection well, each such production well being drilled to substantially the vicinity of a side pocket mandrel of the injection well.

8. A system for recovering petroleum from subterranean viscous petroleum tar sands comprising:

at least one injection well which is deviated from the perpendicular and extends for at least a portion of its length into said subterranean viscous petroleum tar sand, said injection well having disposed therein:

a casing lining said well, and being perforated at at least one site therein, a dual tubing string disposed within said casing providing a circulation path for the use of through the flowline service tools, at least one of said dual tubing strings having a plurality of spaced apart side pocket mandrels, with means therein for regulating the flow of fluids from the bore of said tubing to the outside thereof, means for packing off the tubing casing annulus situated between the uppermost side pocket mandrel and the surface of the well, and at least one production well extending from the surface into said subterranean viscous petroleum tar sands positioned above and along the length of said injection well, whereby a heated fluid circulated through said injection well exits said well through said flow regulator means into said subterranean viscous petroleum tar sands to reduce the viscosity of the petroleum contained therein, which is recovered through said production well.

9. The system of claim 8, wherein there is one production well located essentially above and at a site which is essentially at the terminal point of the injection well.

10. The system of claim 8, wherein said means, in said side pocket mandrels, for regulating the flow of fluids from the bore of the tubing to the outside thereof, comprises a constant flow regulator.

11. The system of claim 8, wherein said means, in said side pocket mandrels, for regulating the flow of fluids from the bore ot the tubing to the outside thereof, comprises an orifice regulator.

12. The system of claim 8, additionally including a plurality of means, positioned along said dual tubing string, for packing off the tubing-casing annulus between said side pocket mandrels.

13. The system of claim 12, wherein said packing off means are a steam packer.

* * * * *